US005282686A

United States Patent [19]

Haber

[11] Patent Number: 5,282,686

[45] Date of Patent: Feb. 1, 1994

[54] SHOPPING BAG HAVING CLOSURE MEANS

[76] Inventor: Terry M. Haber, 25011 Castlewood, El Toro, Calif. 92630

[21] Appl. No.: 955,841

[22] Filed: Oct. 2, 1992

[51] Int. Cl.[5] ..... B65D 33/08

[52] U.S. Cl. ..... 383/10; 383/77; 383/207

[58] Field of Search ..... 383/10, 62, 71, 77, 383/24, 207, 200; 24/30.5 P

[56] References Cited

U.S. PATENT DOCUMENTS

| | | | |
|---|---|---|---|
| 956,941 | 5/1910 | Chapman | 383/62 |
| 1,128,192 | 2/1915 | Smith | 383/62 |
| 3,107,842 | 10/1963 | Guilfoyle | 383/62 |
| 3,774,838 | 11/1973 | Christie | 383/77 |
| 4,445,230 | 4/1984 | Spadaro | 383/77 X |
| 4,477,950 | 10/1984 | Cisek et al. | 24/30.5 |
| 4,592,091 | 5/1986 | Italici | 383/24 X |
| 4,753,538 | 6/1988 | Jordá383 | 77 X/ |
| 4,906,108 | 3/1990 | Herrington et al. | 383/71 |
| 5,044,775 | 9/1991 | Rutledge | 383/71 X |

FOREIGN PATENT DOCUMENTS

| | | | |
|---|---|---|---|
| 2490190 | 3/1982 | France | 383/77 |
| 2632274 | 12/1989 | France | 383/77 |

*Primary Examiner*—Allan N. Shoap
*Assistant Examiner*—Christopher McDonald
*Attorney, Agent, or Firm*—Hawes & Fischer

[57] ABSTRACT

A shopping-type bag manufactured from lightweight plastic, or the like, and having a normally open mouth through which articles to be carried are received within and removed from the bag. A plurality of elongated, flexible strips are coextensively connected to and extended from the bag. The strips are of sufficient length to be mated together to constrict or close the mouth opening and thereby prevent the articles being carried from inadvertently falling out when the bag is tilted, jostled or laid horizontally. Each of the strips is provided with a series of serrations extending thereacross at which the strips may be severed from the bag so that the mouth can be quickly and easily reopened to permit access to the articles being carried within the bag.

11 Claims, 2 Drawing Sheets

SHOPPING BAG HAVING CLOSURE MEANS

BACKGROUND OF THE INVENTION

1. Field of the Invention

This invention relates to a shopping-type bag manufactured from a lightweight material and including a plurality of elongated, flexible strips that are adapted to be tied together to close or constrict the mouth opening of the bag and thereby prevent the contents from spilling out when the bag is tilted, jostled or laid horizontally.

2. Background Art

Plastic, cloth and paper bags have been regularly used by shoppers to carry groceries and other articles. However, the contents of the bag may fall out through the normally open mouth thereof when the bag is tilted or laid horizontally. Consequently, a shopper must be careful to avoid spilling the contents when handling such a bag, particularly when several bags are being carried at the same time, when the shopper bends over, when the bag is laid flat on a car seat, and when the bag is jostled or the shopper bumped. Not only will the shopper be faced with the inconvenience of retrieving and repackaging the spilled contents, but certain articles (e.g. eggs and glass jars) may be susceptible to breakage.

Therefore, it would be desirable to have available a shopping-type bag having a low cost, easy to use means for constricting or closing the mouth opening so as to prevent the contents being carried from spilling out when the bag is tilted, jostled or laid horizontally. It would also be desirable to be able to quickly and easily reopen the mouth of the bag to permit the shopper to gain access to the contents being carried therein.

SUMMARY OF THE INVENTION

In general terms, this invention relates to a shopping-type bag that is manufactured from a lightweight material, such as plastic, paper, cloth, or the like. The bag is closed at the bottom, front, back and opposite sides. The bag also has a normally open mouth through which articles are received in and removed from the bag. A pair of optional handles may be included to facilitate transport of the bag when articles are carried therein.

In accordance with the present invention, a plurality of relatively narrow, flexible strips are coextensively connected to and extended from the bag. In one embodiment, a pair of strips are connected to opposite sides of the bag below respective carrying handles. In another embodiment, a pair of opposing strips are connected to the front and back of the bag. Alternatively the strips may be connected to each of the sides, front and back of the bag. The strips are of suitable length to be tied together to close or constrict the normally open mouth of the bag. By virtue of the foregoing, articles being carried within the bag will not be spilled out as a consequence of the bag being tilted, jostled or laid horizontally. Each strip has a series of serrations extending thereacross at which the strips may be severed from the bag so that the mouth can be quickly and easily reopened to permit access to the articles being carried within the bag. Each strip may also be scalloped along its edges so that opposing strips may be reliably tied together. In addition, one strip may have an opening therethrough for receipt of the opposing strip to facilitate the strips being mated together.

DETAILED DESCRIPTION

Figure 1:
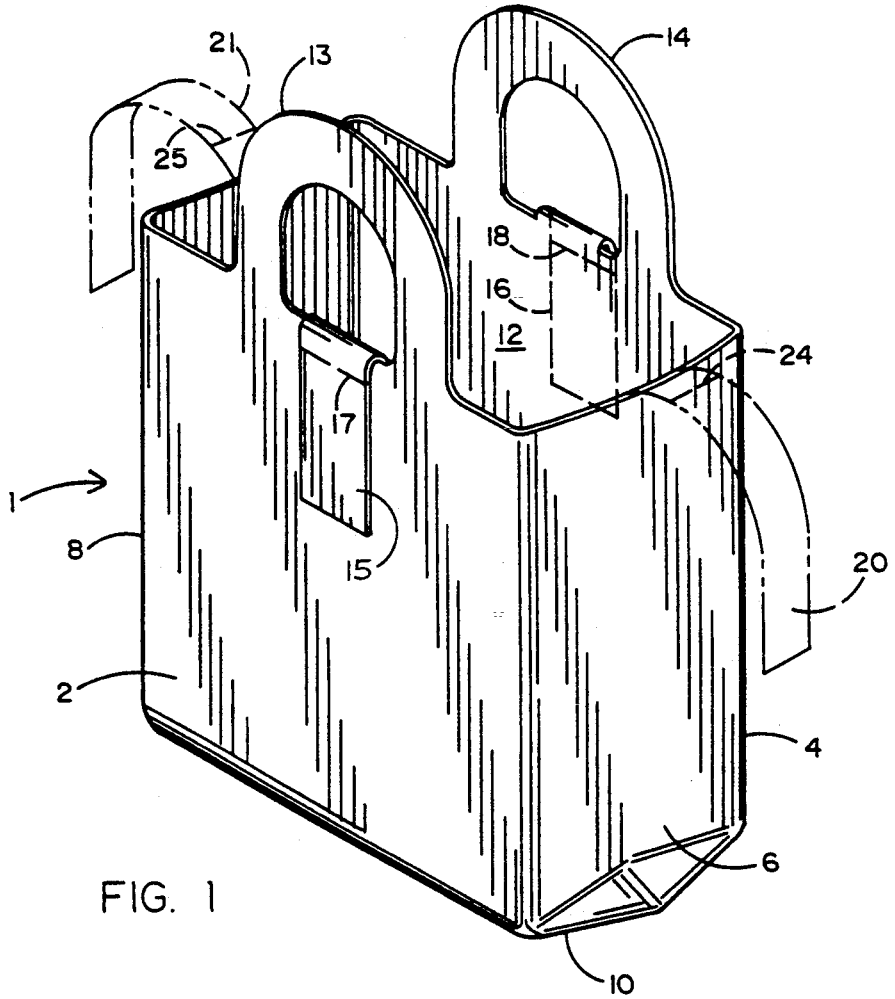
FIG. 1 is a perspective view of a shopping-type bag formed in accordance with the present invention including carrying handles and a plurality of strips adapted to be tied together.
Figure 2:
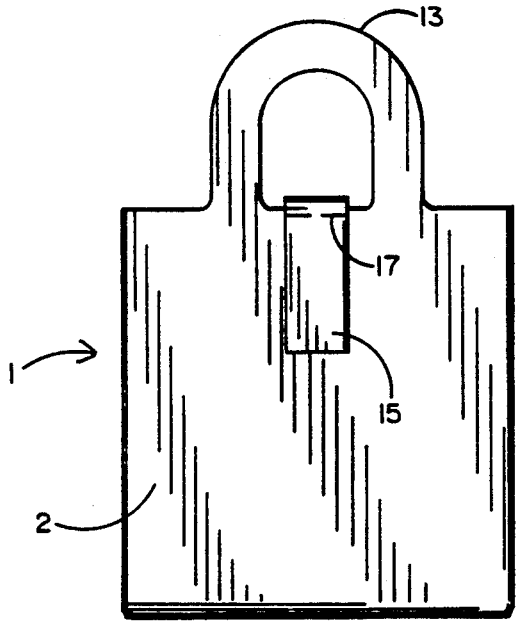
FIG. 2 is a side view of the bag of FIG. 1.
Figure 3:
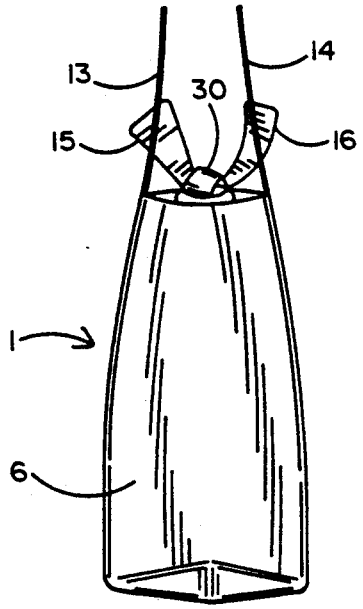
FIG. 3 is a front view of the bag of FIG. 1 showing the strips tied together and the normally open mouth of the bag closed or constricted.

A shopping-type bag 1 which forms the present invention is shown in FIG. 1–3 of the drawings. While it is preferable that the bag 1 be manufactured from plastic, this is not to be regarded as a limitation of the present invention, and bag 1 may also be manufactured from paper, fabric or any other suitable lightweight material. Like conventional shopping bags, the bag 1 of this invention is provided with side panels 2 and 4, front and back panels 6 and 8 and a bottom panel 10. The mouth 12 of the bag 1 is open to receive groceries and other articles to be carried. As in the case of many shopping bags, a pair of looped or U-shaped carrying handles 13 and 14 are coextensively formed with and extended from the opposite side panels 2 and 4 to facilitate transporting the articles within bag 1 from place to place.

In accordance with the present invention, a pair of relatively narrow, flexible strips 15 and 16 are coextensively connected to and extended from respective side panels 2 and 4 of bag 1. Strips 15 and 16 are manufactured from the same material (e.g. plastic) used to manufacture the remainder of shopping bag 1. As shown in FIGS. 1 and 2, the strips 15 and 16 are connected to the bag 1 within the loops formed by respective U-shaped carrying handles 13 and 14. Each strip 15 and 16 has a series of serrations 17 and 18 extending laterally thereacross. The serrations 17 and 18 are located near the ends of strips 15 and 16 which are connected to respective side panels 2 and 4. The advantage of strips 15 and 16 and the serrations 17 and 18 thereof will soon be disclosed.

As an alternate embodiment, a pair of additional flexible strips 20 and 21 (shown in phantom lines in FIG. 1), may be coextensively connected to and extended from respective front and back panels 6 and 8 of shopping bag 1. Like the previously described strips 15 and 16, each of the strips 20 and 21 has a series of serrations 24 and 25 extending laterally thereacross and located near the end closest to the front or back panel 6 or 8. In this regard, it is to be understood that this invention contemplates the use of strips 15 and 16 or strips 20 and 21 or each of strips 15, 16, 20 and 21.

The elongated, flexible strips extending from shopping bag 1 are of sufficient length to be located within carrying handles 13 and 14 and still be tied together. That is to say, strips 15 and 16 can be tied together to pull the opposing side panels 2 and 4 of bag 1 towards one another. Or, strips 20 and 21 can be tied together to pull the opposing front and back panels 6 and 8 towards one another. By way of particular example, and referring now to FIG. 3, the strips 15 and 16 are shown tied into a knot 30. In this manner, the opposing side panels 2 and 4 of bag 1 will be pulled towards one another to thereby constrict or close the normally open mouth 12. By virtue of the foregoing, the articles being carried within the shopping bag 1 will not be susceptible to falling out and possible damage in the event that the bag is either tilted, jostled or laid horizontally, such as on the seat of a car.

When it is desirable to reopen the mouth 12 of shopping bag 1 to gain access to the contents being carried therein, the knot 30, formed by tying strips 15 and 16 together, may be either untied or severed from the bag. More particularly, the shopper may cut or tear the strips 15 and 16 at their respective serrations 17 and 18 to quickly and easily open bag 1 without having to first untie the knot 30. The knot 30 may then be discarded in the usual fashion. The contents of the bag 1 are now readily available to be removed and used for their intended purpose.

Figure 4:
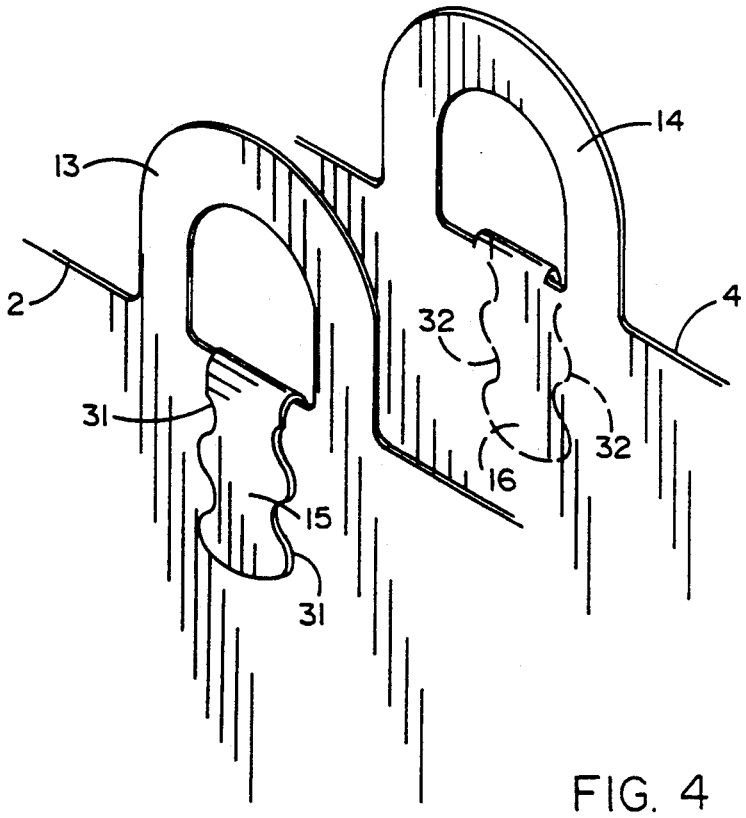
FIG. 4 shows the strips having scalloped edges to facilitate their being reliably tied together.

FIG. 4 of the drawings shows an alternate embodiment of the present invention where the strips (e.g. 15 and 16) are provided with respective scalloped edges 31 and 32. Such scalloped edges 31 and 32 maximize the reliability of the knot 30 that is formed by tying strips 15 and 16 together (as illustrated in FIG. 3).

Figure 5:
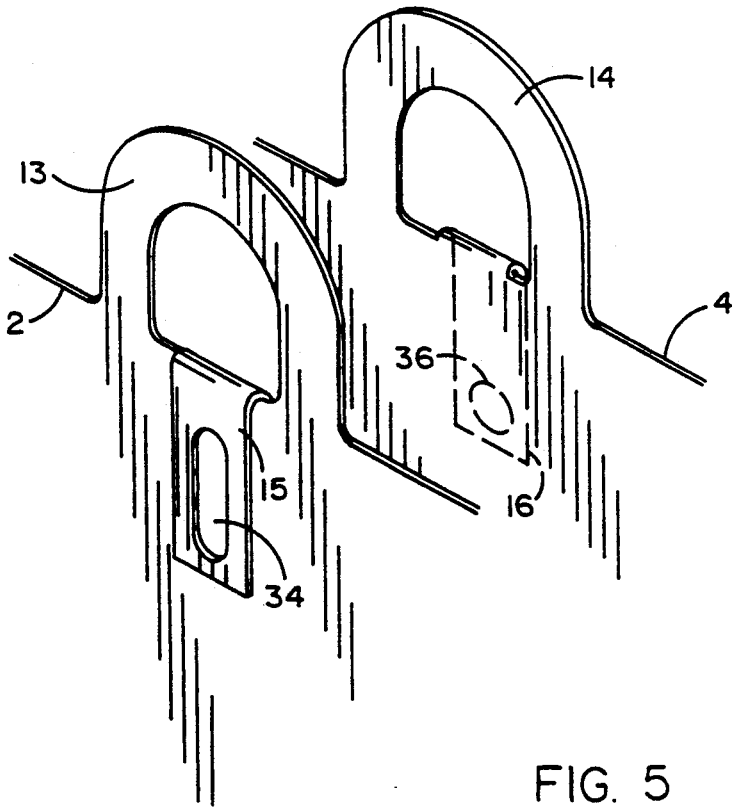
FIG. 5 shows one strip having an opening therethrough for receipt of the opposing strip to facilitate the strips being mated together and the bag closed.

FIG. 5 of the drawings shows another alternate embodiment of this invention where one of the strips (e.g. 15) has an opening 34 formed therethrough and the opposing strip 16 has a portion of adhesive 36 applied thereto. In use, the strip 16 is pulled through the opening 34 in strip 15 and then attached to strip 15 by means of adhesive 36. Thus, the bag 1 may be closed without having to tie the knot 30 of FIG. 3. Moreover, the bag 1 may be reopened without having to untie or sever the knot. That is, the opposing strips 15 and 16 may be easily pulled apart by simply separating strip 15 from the adhesive at strip 16.

It will be apparent that while a preferred embodiment of the invention has been shown and described, various modifications and changes may be made without departing from the true spirit and scope of the invention.

Having thus set forth the preferred embodiment of the invention, I claim:

1. For a bag to receive and transport articles and including a front, back, bottom, a pair of opposing sides, and a normally open mouth formed between said front, back and sides through which the articles are received by and removed from the bag, the improvement comprising a plurality of flexible strips connected to and extending from said bag by which to constrict said mouth to prevent the articles being transported in said bag from inadvertently spilling out, each of said plurality of strips having a length so that said strips can be tied together to form a closure which constricts said mouth, a width, and a series of serrations extending across the width so that each strip may be severed at a respective series of serrations and said closure removed from said bag to release the constriction of said mouth.

2. For the bag recited in claim 1, said plurality of flexible strips including a first strip connected to and extending from one of the sides of said bag and a second strip connected to and extending from the opposing side of said bag, said first and second strips adapted to be tied together to pull the opposing sides of said bag towards one another and thereby constrict said mouth.

3. For the bag recited in claim 1, said plurality of flexible strips including a first strip connected to and extending from the front of said bag and a second strip connected to and extending from the back of said bag, said first and second strips adapted to be tied together to pull the front and back of said bag towards one another and thereby constrict said mouth.

4. For the bag recited in claim 1, wherein said bag is manufactured from plastic.

5. For the bag recited in claim 1, including a plurality of U-shaped carrying handles connected to and extending from said bag, each of said flexible strips connected to said bag within the U of a respective handle.

6. For the bag recited in claim 1, wherein the edges of each of said plurality of strips is scalloped.

7. For the bag recited in claim 1, a first one of said plurality of strips having an opening formed therethrough for receipt of a second one of said strips to permit said strips to be mated together.

8. For the bag recited in claim 7, wherein the second one of said strips has a portion of adhesive applied thereto for attachment to said first strip to permit said first and second strips to be mated together after said second strip is received through the opening of said first strip.

9. For a bag to receive and transport articles and including a front, back, bottom, a pair of opposing sides, a normally open mouth formed between said front, back and sides through which the articles are received by and removed from the bag, and at least two U-shaped carrying handles connected to and extending from respective ones of said front, back or sides of said bag, the improvement comprising at least two flexible strips having sufficient length so as to be mated together to constrict said mouth and thereby prevent the article being transported in said bag from inadvertently spilling out, said flexible strips coextensively connected to corresponding ones of said front, back or sides of said bag to which said handles are connected and sized to be located completely within the U of respective ones of said handles.

10. For a bag to receive and transport articles and including a front, back, bottom, a pair of opposing sides, and a normally open mouth formed between said front, back and sides through which the articles are received by and removed from the bag, the improvement comprising at least two flexible strips integrally connected to and extending from said bag so as to be mated together to constrict said mouth and thereby prevent the articles being transported in said bag from inadvertently spilling out, a first of said flexible strips having an opening therethrough for receipt of the second of said strips at which said two strips are mated together.

11. For the bag recited in claim 10, wherein the second of said strips has a portion of adhesive applied thereto for attachment to the first of said strips to permit said first and second strips to be mated together after said second strips is received through the opening of said first strip.

* * * * *